United States Patent [19]

Guffroy

[11] Patent Number: 4,500,560

[45] Date of Patent: Feb. 19, 1985

[54] PROCESS FOR ENAMELLING OBJECTS ELECTROSTATICALLY BY MEANS OF A GUN

[75] Inventor: Gerard Guffroy, Vendome, France

[73] Assignee: De Dietrich & Cie, France

[21] Appl. No.: 407,036

[22] Filed: Aug. 11, 1982

[30] Foreign Application Priority Data

Feb. 9, 1982 [FR] France ..... 82 02038

[51] Int. Cl.[3] ..... B05D 1/06

[52] U.S. Cl. ..... 427/8; 427/27; 427/28; 427/182; 427/185; 427/236; 427/427; 118/629; 118/688

[58] Field of Search ..... 427/27, 28, 182, 185, 427/236, 427, 8; 118/622, 629, 688

[56] References Cited

U.S. PATENT DOCUMENTS

| | | | |
|---|---|---|---|
| 3,551,178 | 12/1970 | Chemelar | 427/27 |
| 4,027,050 | 5/1977 | Haig | 427/27 |
| 4,109,027 | 8/1978 | Crose | 427/27 |
| 4,114,564 | 9/1978 | Probst | 427/27 |
| 4,377,603 | 3/1983 | Itoh et al. | 427/27 |

*Primary Examiner*—Richard Bueker

*Attorney, Agent, or Firm*—Burns, Doane, Swecker & Mathis

[57] ABSTRACT

In this process comprising fluidizing the enamel powder in a fluidization vessel by blowing air in the bottom of the latter, steam is also introduced in the vessel in the course of the fluidization. The relative humidity is adjusted in the vessel to a value between about 15 and 45% in respect of a temperature in the vessel of between about 20° and 30° C. A steam boiler (12) is connected to the fluidization vessel (1) for this purpose.

7 Claims, 2 Drawing Figures

PROCESS FOR ENAMELLING OBJECTS ELECTROSTATICALLY BY MEANS OF A GUN

DESCRIPTION

Figure 1:
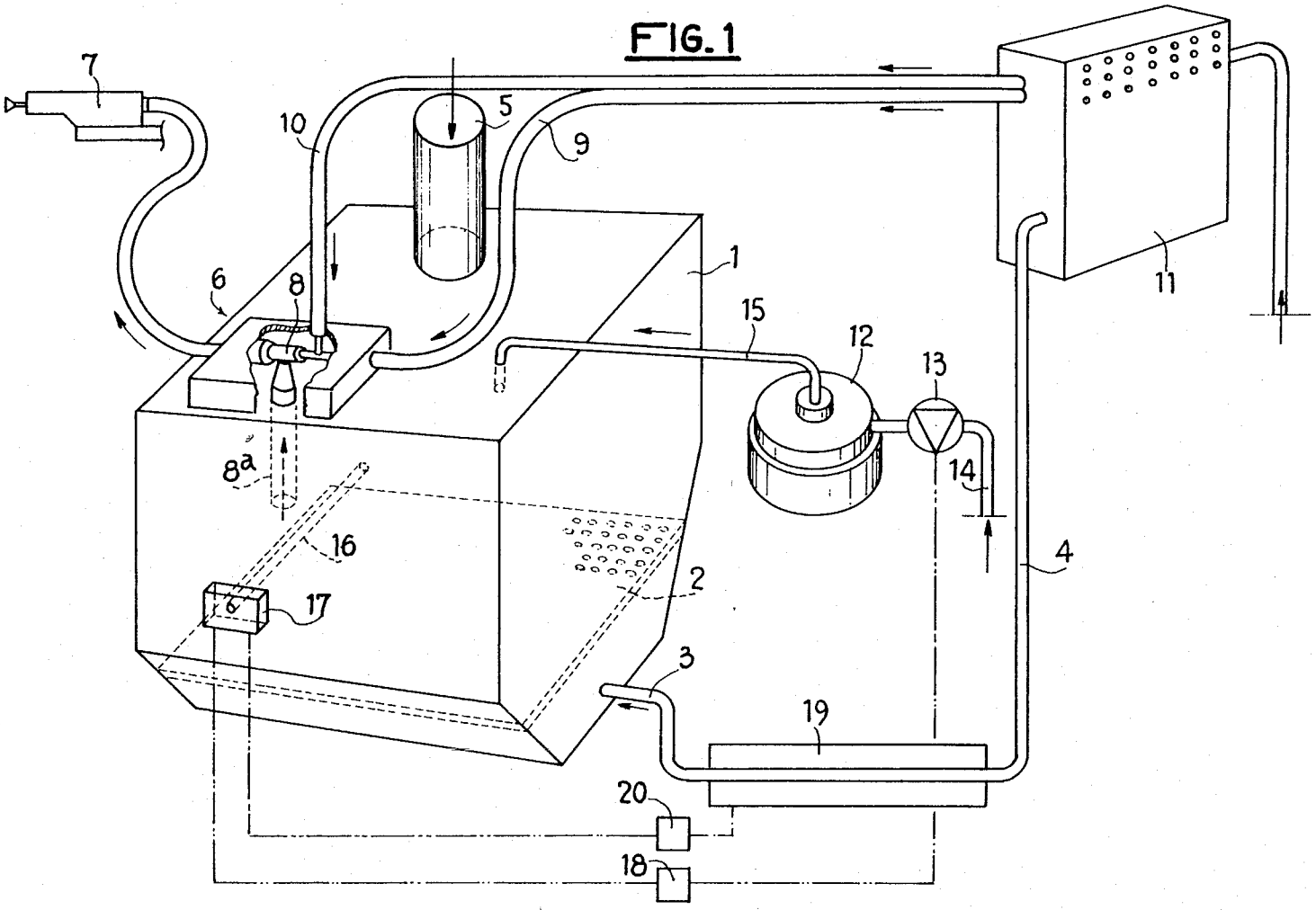

The present invention relates to the enamelling of generally metallic parts by a process electrostatically applying enamel in the form of a powder. Those skilled in the art know that the carrying out of processes which apply powdered enamel electrostatically are highly dependent, as to their good operation, on the hygrometric state of the air surrounding the gun. This hygrometric state in particular affects the thickness of the deposit and the adherence of the powder to the parts.

In order to satisfy these requirements, it is already known to impart to the air surrounding the application zone temperature and humidity characteristics which are defined with precision.

In order to achieve this object, it has been proposed to put the paint application unit in an air-conditioned enclosure and to dry the air supplied to this enclosure to a variable extent.

However, such a unit has in particular two drawbacks.

An air-conditioned enclosure markedly complicates the unit since there must be constructed in the enamelling shop a cabin which is completely closed and communicates with the exterior solely by way of passages provided therein for conveying the parts.

Further, it has been found that, notwithstanding the precise regulation of the atmosphere in the cabin, the results of the application of the enamel powder depend on exterior climatic conditions and in particular on the humidity of the air. Thus, in accordance with the atmospheric conditions, the deposits of enamel on the parts vary in thickness. This is due to the fact that the air which supplies and carries the powdered enamel to the parts, may have characteristics which are very different from the optimum conditions of application. Indeed, this air is very often produced by compressors located outside the air-conditioned enclosure and thereafter dried. The characteristics of this air consequently depend on the exterior climatic conditions. In the zone of application, this air expels the surrounding conditioned air and determines practically alone the conditions of application of the powder.

In order to avoid these problems, it is also known to introduce water in a liquid phase at various points of a unit such as, for example, on the periphery of the mouth pieces of the guns, in the application cabin or in the conveying air.

However, such an introduction of water does not give favourable results.

An object of the invention is therefore to provide a process for treating the mixture of air and powdered enamel for the electrostatic application, by means of a gun, on objects which must be enamelled which avoids the aforementioned drawbacks.

According to the invention, there is provided such a process comprising fluidizing the powdered enamel in a fluidization vessel by blowing air in the bottom of the vessel, extracting the fluidized powder from the vessel by entraining the powder by means of a stream of conveying air which carries the powder to an electrostatic application gun, wherein steam is also introduced in the fluidization vessel.

By means of this process, it becomes possible, with the use of simple devices, to determine with a very high precision, the humidity content of the mixture of air and powder conveyed to the application guns. In view of the fact that the humidity of the mixture of air and powder in the fluidization vessel is mastered and that this mixture is determinant as concerns the conditions of application, as mentioned hereinbefore, it is possible to dispense with an air-conditioned cabin and other measures for regulating the surrounding atmosphere of the place where the powder is applied. Further, the introduction of steam in the fluidization vessel may be achieved by means of a servo or feedback control as a function of the real value of the humidity prevailing in this vessel.

Figure 2:
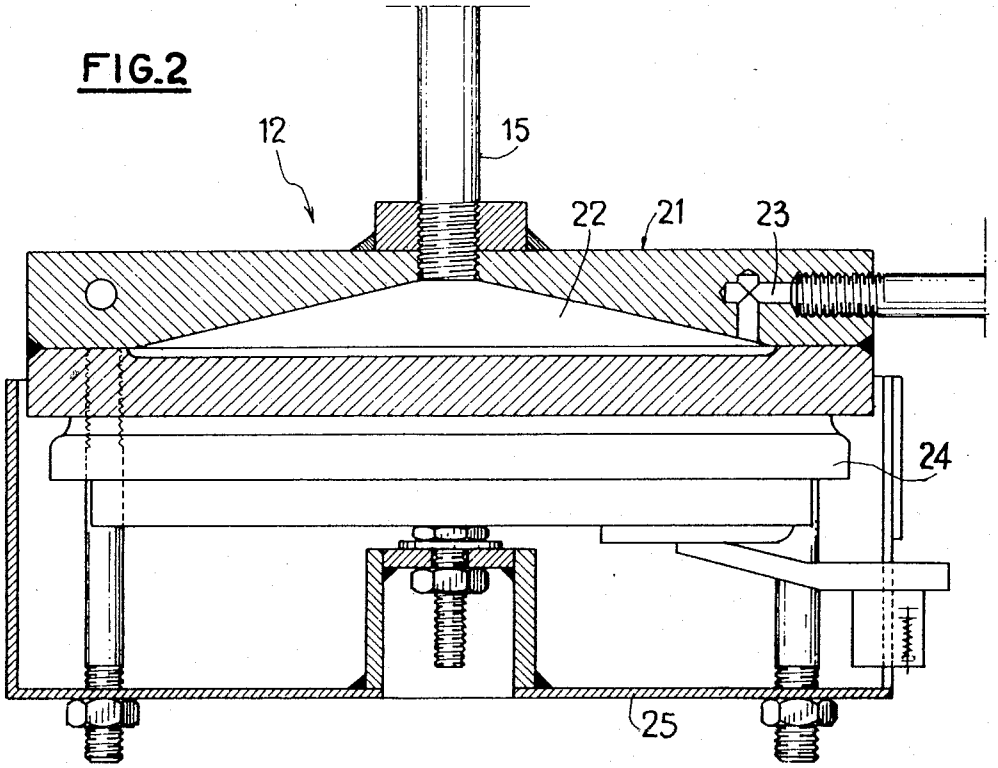

Further features and advantages of the invention will be apparent from the ensuing description which is given solely by way of example with reference to the accompanying drawings, in which:

FIG. 1 is a very diagrammatic assembly view of a unit for the application of powdered enamel according to the invention, and FIG. 2 is a sectional view, to an enlarged scale, of a steam boiler which may be employed for carrying out the process according to the invention.

FIG. 1 shows a fluidization vessel which is in the form of a tank whose lower part is downwardly convergent. Placed in this lower part is a grate 2 below which there is placed a nozzle 3 connected to a fluidization air pipe 4.

The vessel 1 is closed in its upper part and communicates with a powdered enamel supply device by way of a vertical pipe 5.

Mounted on the cover is a device 6 for taking off fluidized powder so that the latter is conveyed to an application gun 7. It will be understood that the same fluidization vessel may supply powdered enamel to a plurality of guns if required.

The taking-off device comprises a pipe 8*a* which descends vertically in the vessel 1. A Tee union 8 comprises a horizontal branch in which a stream of conveying air passes which is applied to the taking-off device 6 by way of a conveying air pipe 9. Just upstream of the Tee union 8, a supply pipe 10 for dosage air is connected to the pipe 9.

The various streams of air introduced respectively in the pipes 4, 9 and 10 are obtained in a distribution box 11 which is connected to a source of air under pressure (not shown) provided with the usual purifying devices such as a drier and an oil-separator.

According to the invention, the fluidization vessel 1 is associated with a steam boiler 12 which is connected, on one hand, by its inlet to a dosage pump 13 supplied with water by way of a pipe 14 and, on the other hand, by its outlet, to an outlet pipe 15 leading to the fluidization vessel 1 through the cover of the latter.

A humidity and temperature sensor 16 is disposed in the vessel and connected to a regulating device 17 whereby the signal detected by the sensor 16 and a set or reference humidity signal may be sent, on one hand, to the dosage pump 13 by way of a regulating device 18 and, on the other hand, to an air heater 19 by way of a regulating device 20.

An embodiment of the construction of the steam boiler is shown in FIG. 2. It comprises a metal unit 21 defining a chamber 22 which produces steam and has a generally conical shape the apex of which communicates with the pipe 15. The pump 13 has its delivery side connected to a pipe 23 which opens onto the periphery of the chamber 22. The unit 21 is heated by means of an electric heating plate 24 which may remain permanently connected to the supply or be regulated in accordance with needs. The steam boiler 12 is completed by a lower protecting cover 25.

The unit just described operates in the following manner:

The powdered enamel is introduced in the fluidization vessel by way of the pipe 5. The fluidization air introduced in the bottom of the vessel by way of the pipe 3 puts this powder in suspension while the conveying air travelling through the pipe 9 constantly takes off powder in suspension and conveys it to the guns 7. The fine dosage of the amount of powder conveyed per unit time is achieved by acting on the stream of the air in the pipe 10, in the known manner. The regulating device 17 permits the setting, for a given temperature, of a desired degree of humidity within the vessel 1. If this set value corresponds to the value detected by the sensor 16, the servo control is at rest. On the other hand, when a deviation occurs between the two values, the servo control can act either on the amount of steam produced by modifying the speed of the pump 13, or on the temperature of the fluidization air by modifying the supply of power to the heater 19.

Thus it can be seen that the process according to the invention permits the precise adjustment by simple means of the relative humidity of the powdered enamel conveyed to the guns 7. It has been found in practice that the introduction of steam in the vessel 1 is sufficient to obtain very good results, even on hollow parts such as, for example, the muffles employed for the construction of household cooking ovens which have up to the present time always presented difficulties as concerns the enamelling of the interior walls. The process according to the invention gives excellent results with these hollow objects without the use of an air-conditioned cabin which was the usual practice in the prior art.

The value of the relative humidity in the fluidization vessel 1 may be between 15 and 45% for a temperature of the air in this vessel of between 20° and 30° C. Preferred values of the relative humidity are between 27 and 30%, the best results having been obtained for a value of 25%. Within these ranges of relative humidity and temperature, it has been found that it was possible to introduce 3 to 12 grams of water in the form of steam in the powder in suspension in the vessel per cubic metre of air introduced.

By way of example, enamel powders of the type manufactured by the firm Ferro and designated by the reference ME 471 or manufactured by the firm Bayer and designated by the reference AC 8799/MX 5016, gave excellent results with the process according to the invention.

having now described my invention whate I claim as new and desire to secure by Letters Patent is:

1. A process for electrostatic enamelling objects and in particular hollow metallic objects by gun means and powdered enamel, comprising:

(a) generating a first air flow for conveying said powdered enamel towards said gun means;

(b) generating a second air flow for fluidizing said powdered enamel in a fluidization vessel and applying said second air flow into the bottom of said vessel;

(c) generating a steam flow second from said first or second air flows;

(d) applying said steam flow into the top of said vessel so as to moisten the fluidized powdered enamel contained therein; and (e) conveying said fluidized moistened powdered enamel into said gun means by means of said first air flow.

2. A process according to claim 1, wherein the relative humidity in the vessel is regulated to a value of between about 15 and 45% in respect of a temperature in the vessel of between about 20° and 30° C.

3. A process according to claim 2, wherein the relative humidity is between about 27 and 30%.

4. A process according to claim 2, wherein the relative humidity is 25%.

5. A process as claimed in claim 1 further comprising previously drying and first and second air flows.

6. A process according to any one of the claims 1, 2, 3 or 4, comprising controlling the amount of steam introduced in the fluidization vessel in accordance with the value of the relative humidity prevailing in the vessel.

7. A process according to claim 6, comprising controlling the temperature of the fluidization air in accordance with the relative humidity prevailing in the vessel.

* * * * *